United States Patent [19]

Leahy

[11] 3,940,084

[45] Feb. 24, 1976

[54] MEASURING AND CUTTING MACHINE

[76] Inventor: William Richard Leahy, 16 Buckley St., Footscray, Victoria, Australia

[22] Filed: Aug. 16, 1973

[21] Appl. No.: 388,784

[52] U.S. Cl. ..... 242/110.2; 242/55

[51] Int. Cl.[2] ..... B65H 75/24

[58] Field of Search..... 242/55, 56 R, 67.1 R, 67.2, 242/67.3 R, 62, 110.1, 110.2

[56] References Cited

UNITED STATES PATENTS

| | | | |
|---|---|---|---|
| 823,193 | 6/1906 | Snedeker | 242/55 |
| 2,678,175 | 5/1954 | Wiig | 242/110.2 |
| 2,809,674 | 10/1957 | Ward | 242/110.2 X |
| 2,819,760 | 1/1958 | Norehead | 242/110.1 X |
| 3,421,712 | 1/1969 | Scroggie | 242/110.1 |

*Primary Examiner*—Edward J. McCarthy

[57] ABSTRACT

A machine for producing a number of lengths of fabric or similar material comprises a frame supporting a sub-frame for movement thereon. The sub-frame causes an adjustable winder comprising a shaft rotatable in bearings on the sub-frame and at least three supporting members parallel to but spaced from the shaft and spaced about the axis of rotation. The supporting members are carried by the shaft and the radial spacing thereof is variable to thereby vary the distance between the supporting members. At least one of the members has means for gripping one end of a sheet of material and driving means are associated with the supporting members to rotate the members about the shaft axis to thereby wind the sheet material around the members.

10 Claims, 5 Drawing Figures

MEASURING AND CUTTING MACHINE

BACKGROUND OF INVENTION

This invention relates to an improved measuring and cutting machine and relates particularly to a machine for use in cutting a plurality of lengths of sheet material.

Heretofor when it was desired to cut sheet material, such as fabric material or the like, to a desired length for the manufacture of curtains, sheets and the like, the roll of material was supported in a holder and the material run out onto a table where it was then clamped, measured and cut by an operator. This method of cutting lengths of material is extremely slow and uneconomical as it enables only one length to be measured out and cut at any one time. Further, if several lengths of material are to be cut, varying tensions applied to each length can result in inaccuracies in the cut lengths.

SUMMARY OF INVENTION

It is an object of the invention to provide apparatus which will facilitate accurate measurement and cutting of a plurality of lengths of sheet material.

It is further object of the invention to provide apparatus which will allow cutting of multiple lengths of material at the same time.

A still further object of the invention is to provide apparatus wherein the length of material cut is adjustable.

A still further object of the invention is to provide means for tensioning material as it is drawn from a roll.

Another object of the invention is to provide tensioning, measuring and cutting apparatus which is relatively simple and economical to manufacture.

According to one aspect of the invention there is provided a machine for producing a plurality of lengths of sheet material from a roll of the material comprising a frame, fabric supporting means rotably mounted on the frame, said fabric supporting means including at least three members spaced about the axis of rotation of said means and extending substantially parallel thereto, the members being mounted for selective movement towards or away from said axis so as to selectively vary the spacing of the members relative to each other, means associated with at least one member to grip the transverse end of a length of sheet material, driving means to rotate said members about said axis to thereby wind material about the members so that one or more layers of material are supported by the members, and means for cutting said layers substantially parallel to the members to produce a plurality of lengths of said material of substantially equal length.

The invention also provides a tensioning device for use in tensioning the sheet material comprising a number of rows of bristles extending upwardly from a support, the rows of bristles extending at least across the width of the material to be tensioned, a roller or a second set of bristles mounted on a movable support, said movable support adapted to move to engage the roller or the second set of bristles with the first set of bristles, and means for drawing sheet material therebetween.

Although the invention is described with reference to sheet fabric material, it will be appreciated that the invention may be used with any flexible sheet material such as synthetic plastic material, paper, metal, foil and the like.

DESCRIPTION OF DRAWINGS

In order that the invention will be more readily understood one embodiment thereof will now be described with reference to the accompanying drawings, wherein.

DETAILED DESCRIPTION

Figures 1, 5:
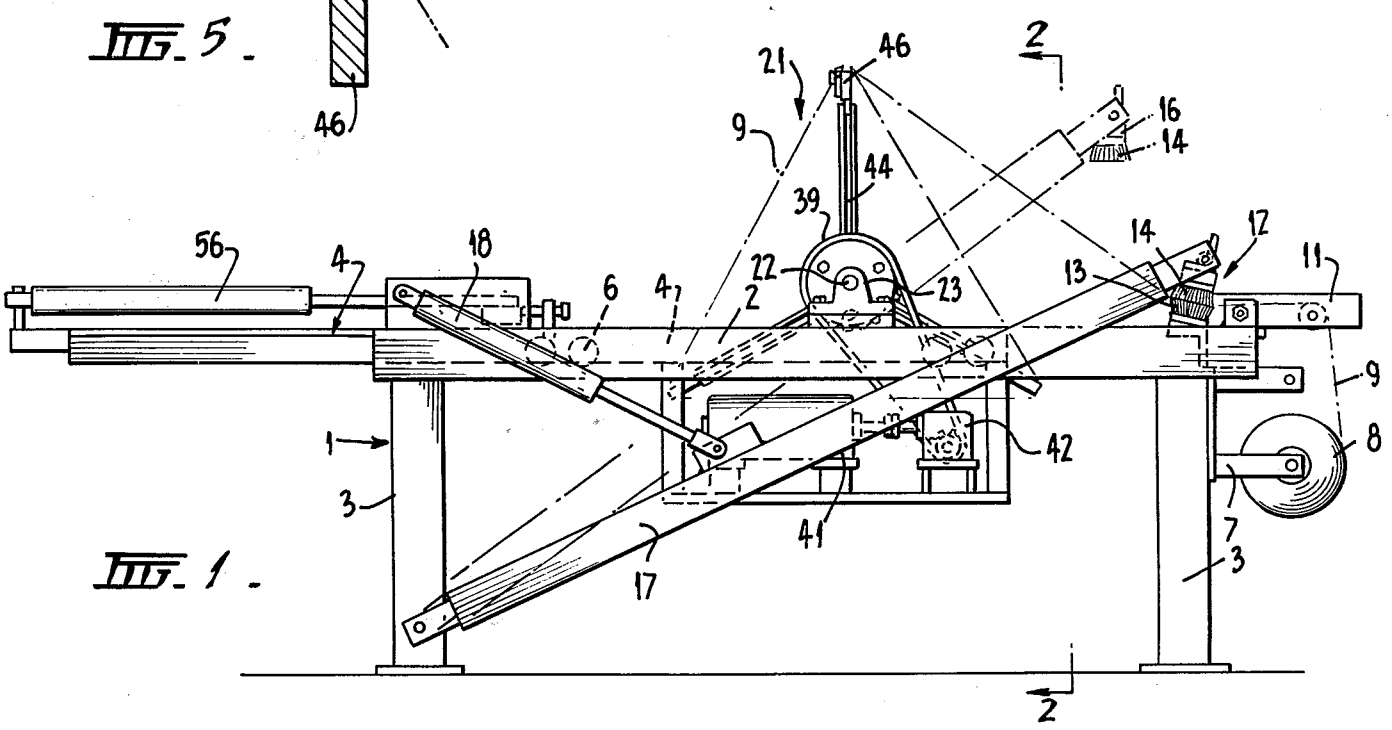
FIG. 1 is a side elevational view of a machine made according to the present invention.
FIG. 5 is a view taken along the line 5—5 in FIG. 2.
Figures 2, 3, 4:
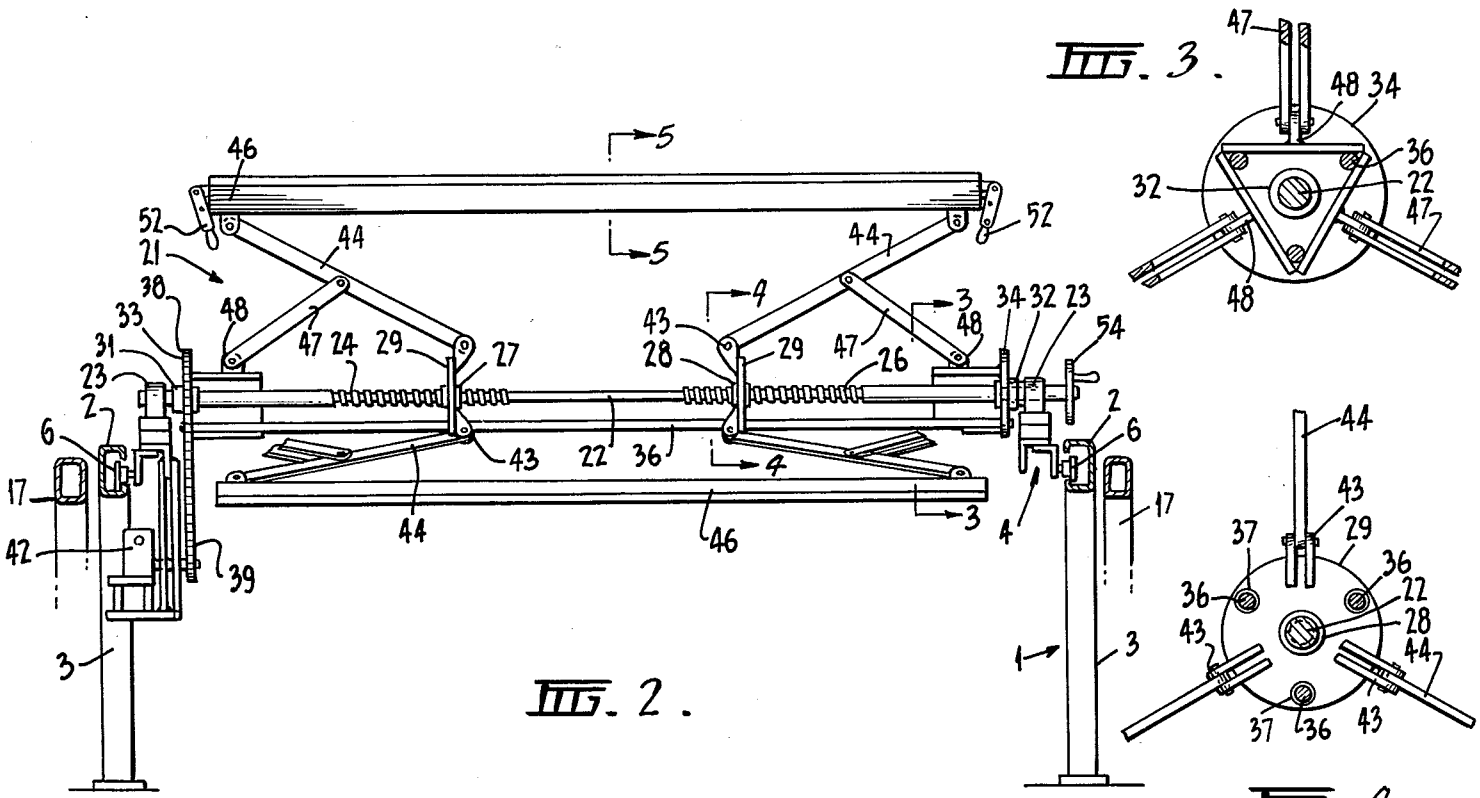
FIG. 2 is a sectional end elevational view taken along the line 2—2 in FIG. 1.
FIG. 3 is a detailed sectional view taken along the line 3—3 in FIG. 2.
FIG. 4 is a further detailed sectional view taken along the line 4—4 in FIG. 2.

Referring to the drawings, the machine comprises a base frame 1 having horizontal rails 2 supported by four legs 3. The horizontal rails 2 are of C-shaped cross-section and a secondary frame 4 is mounted for movement along the rails 2 with wheels 6 fixed to the movable frame 4 engaging in the rails 2 to support the movable frame 4.

Brackets 7 are fixed to one pair of legs 3 at one end of the machine, the brackets 7 being arranged to support at least one roll 8 of fabric material 9 which is to be cut into a plurality of lengths.

A guide table 11 is attached to the end of the frame 1 above the brackets 7, the table 11 being arranged to support and guide material 9 taken from a roll 8 to a tensioning device 12. The tensioning device 12 comprises rows of bristles 13 of natural or synthetic material fixed to the base frame 1 and projecting upwardly therefrom. The bristles 13 extend across the width of the frame and may extend vertically or may be inclined towards one or the other end of the base frame. Further rows of bristles 14 are fixed to a support 16 carried by two arms 17 pivoted to opposite legs 3 at the other end of the base frame 1. The arms 17 are movable by a hydraulic or pneumatic cylinder 18, or by manual means, to move the second set of bristles 14 into engagement with the fixed bristles 13. Fabric material 9 is thereby gripped between the two sets of bristles and as the fabric 9 is drawn therethrough the bristles act to apply an even tension to the fabric. The tension may be varied by varying the pressure applied by the second, movable set of bristles 14.

The movable secondary frame 4 carries an adjustable winder 21 about which the fabric material 9 is wound prior to being cut to length. The winder 21 comprises a main shaft 22 supported in bearings 23 on either side of the secondary frame 4. The shaft 22 is formed with two screw threads 24, 26 of opposite hand. Threaded collars 27, 28 engage with the threaded shaft, the collars being formed with integral flanges 29 extending perpendicular to the shaft axis.

Outer collars 31, 32 are located on the shaft 22 adjacent the bearings 23 and each outer collar is also formed with an integral flange 33, 34. Three rods 36 extend between and are secured to the flanges 33 and 34 and the rods 36 pass through holes 37 formed in the flanges 29 on the collars 27 and 28.

One of the flanges 33, 34 is fitted with a chain sprocket 38 for a driving chain 39 driven by a suitable electric motor 41 through a reduction gear-box 42 mounted on a cradle carried by the movable frame 4.

The flange 29 on each threaded collar are provided with three circumferentially spaced brackets 43 which pivotally support outwardly extending arms 44. Corresponding arms 44 from the respective flanges 29 are pivoted to each end of bars 46 equally spaced from the shaft 22. Thus, three bars 46 are each carried by a pair of arms pivoted to the flanges 29.

The bars 46 are maintained substantially parallel to each other and to the shaft 22 by further pairs of arms 47, each arm of each pair of which is pivoted at one end to an arm 44 substantially mid-way along its length, and at its other end to brackets 48 secured to the rods 36 adjacent the flange 33 and 34.

It will be seen that movement of the threaded collars 27 and 28 towards or away from each other causes movement of the respective arms 44 and 47 thus moving the bars 46 towards or away from the shaft 22.

At least one of the bars 46 is fitted with a clamping plate 51 extending along the length of the bar 46. The clamping plate 51 is attached at either end to a pair of levers 52 pivoted to the ends of the bar 46. The levers 52 have an over-centre action such that movement of the levers 52 in one direction causes the clamping plate 51 to be spaced from the bar 46 and movement of the levers 52 in the opposite direction secures the clamping plate against the bar 46.

The bar 46 incorporates a guide channel 53 for a cutter blade used to cut fabric material engaged about the winder 21.

In operation, the length of fabric material to be cut is determined by the spacing of the three bars 46. Adjustment of the threaded collars along the shaft 22 is accomplished by rotating a hand wheel 54 fixed to one end of the shaft 22. The arms attached to the threaded collars are either raised or lowered, depending on the direction of movement of the threaded collars, to thereby vary the spacing of the bars 46 from the shaft 22 and from each other and thus vary the perimeter of the space bounded by the bars 46.

The winder 21 carried by the movable frame 4 is moved towards the tensioning device by means of the hydraulic or pneumatic cylinder 56 on the frame 1. The bars 46 are positioned so that the perimeter of the space defined by the bars 46 is equal to the length to which the material is to be cut. The end of the material is drawn from the tensioning device and is clamped to one of the bars 46 by the clamping plate 51. The movable frame 4 is then moved away from the tensioning device 12 and the winder 21 is rotated by the electric motor driving the shaft 22 through the chain sprocket 38. The winder 22 rotates as a unit in the bearings 23 due to the rods 36 fixed to the driving sprocket passing through the holes 37 in the threaded collar flanges. If desired, a threaded handle may be provided in one of the outer collars 31, 32 to releasably engage the shaft 22 thereby preventing relative rotation between the shaft 22 and the outer collars.

Rotation of the winder causes fabric material to be wrapped around the bars 46, under tension, until the predetermined number of fabric lengths are contained on the winder. The fabric is then cut to the set length by a suitable cutter passing along the cutting guide on one of the bars 46.

Allowance may be made for the tendency for subsequent lengths of material to be greater than initial lengths due to the fabric thickness increasing the distance around the outside of the bars 46. Thus, the shaft 22 may be geared to the outer flanges such that a preset relative rotation is imparted to the shaft as the winder is rotated. Such relative rotation will alter the bar spacing to ensure that the outer fabric length is of the same length as the lengths previously wound.

The machine may be of a width to suit any fabrics to be cut. Also, the fabric may be simultaneously cut into various widths by a suitable number of cutter blades mounted on the movable support carrying the tensioning bristles. These blades are movable along the length of the support so that the fabric may be cut to any suitable width.

A counter may be attached to the movable frame 4 to count the number of turns made by the winder and thus the number of lengths of fabric thereon. Also, a scale may extend adjacent one of the bars to facilitate measurement of the fabric length. The scale is calibrated such that the measurement of the distance between the shaft and one of the bars 46 gives the length of the material.

The tensioning device utilized in the present invention may be used on any cloth measuring and cutting table and provides effective means for tensioning material drawn from a roll. The opposing bristles act to align weft and warp threads to ensure that the material is accurately measured and cut.

The claims defining the invention are as follows:

1. A machine for producing a plurality of lengths of sheet material from a roll of the material comprising a frame, fabric supporting means rotatably mounted on the frame, said fabric supporting means including at least three members spaced about the axis of rotation of said means and extending substantially parallel thereto, the members being mounted for selective movement towards or away from said axis to selectively vary the spacing of the members relative to each other, clamping means on at least one member to clamp the end of a length of sheet material to the said at least one member, driving means to rotate said members about said axis to thereby wind sheet material about the members so that one or more layers of material are supported by the members, and means for cutting said layers substantially parallel to the members to produce a plurality of lengths of said material of substantially equal length.

2. A machine as claimed in claim 1 wherein said fabric supporting means includes a shaft extending along said axis of rotation, the shaft being mounted in bearings carried by the frame, and arm means interconnecting the shaft and said members.

3. A machine as claimed in claim 2 wherein said shaft carries a pair of collars axially movable therealong with means for selectively locating the collars along the shaft, and said arm means includes a first set of arms extending between each collar and the members and a second set of arms interconnected with the first arms and mounted relative to the shaft so that movement of the collars therealong varies the angular relationship between the arms and the shaft to thereby vary the spacing between the members and the shaft.

4. A machine as claimed in claim 2 wherein said driving means includes a flange mounted on the shaft adjacent one end thereof, means for rotating said flange, and interconnecting means between said flange and said arm means to impart driving motion to rotate said members.

5. A machine as claimed in claim 3 wherein said means for locating the collars comprises threads of opposite hands along the shaft and correspondingly threaded collars whereby relative rotation of the shaft and collars causes the collars to move towards or away from each other along the shaft.

6. A machine as claimed in claim 1 wherein said gripping means comprises a clamping plate mounted on one member the clamping plate being movable towards the member to clamp material thereto, and locking means to lock the clamping plate in the clamped position.

7. A machine as claimed in claim 1 wherein a guide channel is mounted on at least one member to guide cutting means there along for cutting material engaged around that member.

8. A machine for producing a plurality of lengths of sheet material from a roll of the material comprising a frame, a shaft mounted for rotation relative to the frame, at least two collars axially movable along the shaft, means for locating the collars at any predetermined axial position along the shaft, a plurality of fabric supporting members spaced around the shaft, the members being adjustably supported in spaced relationship to the shaft by pivoted arms extending between each collar and each member, flange means rotatably mounted on the shaft adjacent each end thereof, means interconnecting the flange means and the collars to prevent relative rotation therebetween without restricting axial movement of the collars along the shaft, secondary arms extending from said flange means and attached to said pivoted arms intermediate the ends thereof, and driving means for rotating said flange means, interconnecting means, shaft, collars, arms and members relative to said frame.

9. A machine as claimed in claim 8 wherein said interconnecting means includes a plurality of bars extending substantially parallel to the shaft and adapted to impart driving motion between the driven flange means and the arm means.

10. A machine as claimed in claim 8 wherein said frame is movable on a fixed frame which carries means for supporting the roll of the material to be cut into lengths, said frame being mounted on wheels which engage in channel rails of the fixed frame.

* * * * *